United States Patent [19]

Rich

[11] 4,067,392

[45] Jan. 10, 1978

[54] TOXIC GAS CONTROL FOR RF ABSORBER FIRES

[75] Inventor: Alan H. Rich, Oxon Hill, Md.

[73] Assignee: The United States of America as represented by the Secretary of the Navy, Washington, D.C.

[21] Appl. No.: 689,692

[22] Filed: May 24, 1976

[51] Int. Cl.[2] ..... A62C 3/00

[52] U.S. Cl. ..... 169/47; 252/8

[58] Field of Search ..... 169/47; 252/8

[56] References Cited

FOREIGN PATENT DOCUMENTS 319,320 6/1930 United Kingdom ..... 252/8

OTHER PUBLICATIONS

Abstract of Canadian Pat. No. 170,901 issued July 18, 1916.

*Primary Examiner*—Leland A. Sebastian

*Attorney, Agent, or Firm*—R. S. Sciascia; Philip Schneider; Melvin L. Crane

[57] ABSTRACT

A method of controlling toxic outgassing of carbon impregnated polyurethane and other radio-frequency-absorbing materials when burning or smouldering. Ammonia gas and water or steam are sprayed onto smouldering material to combine with hydrogen cyanide (HCN) and hydrogen chloride (HCl) formed during-burning to yield ammonium cyanide plus ammonium chloride which yields relatively harmless precipitates when cooled.

2 Claims, 1 Drawing Figure

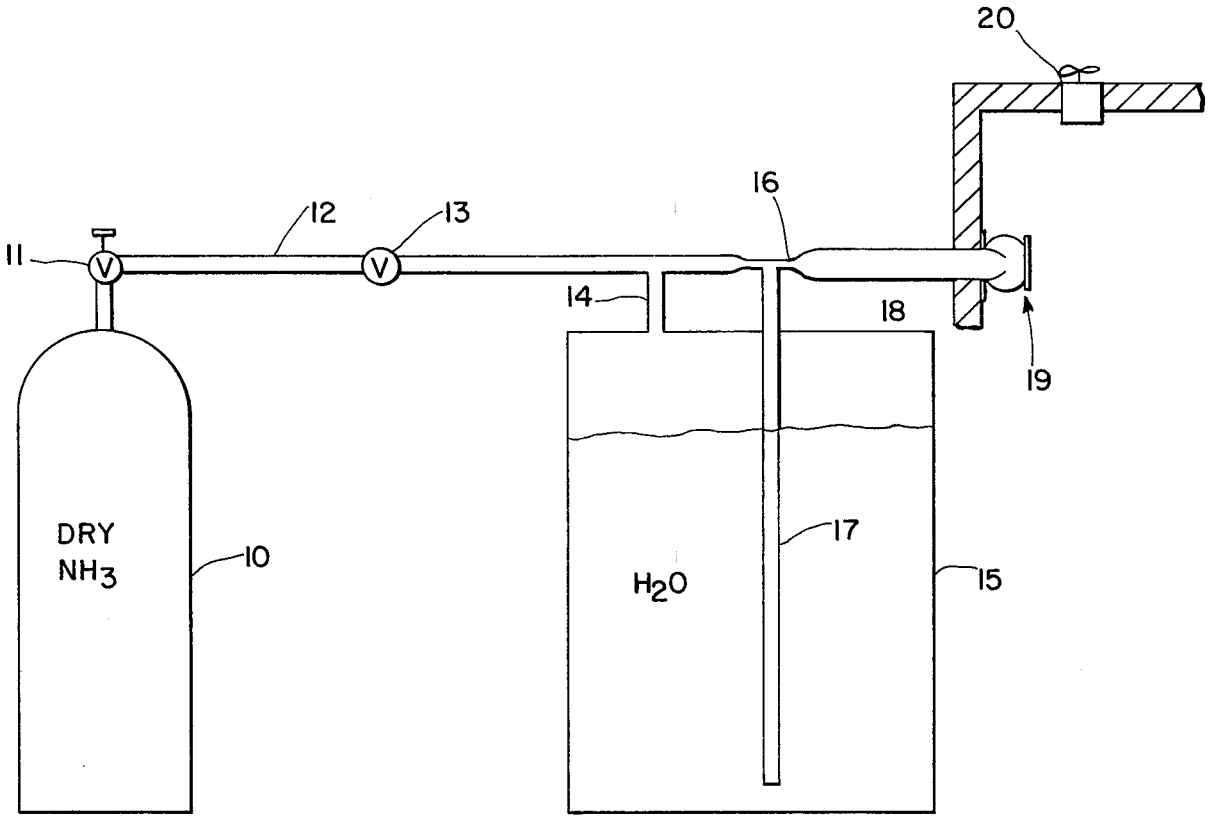
20
19
18
16
15
17
$H_2O$
14
13
12
11
10
DRY
$NH_3$

TOXIC GAS CONTROL FOR RF ABSORBER FIRES

BACKGROUND OF THE INVENTION

This invention relates to a method of controlling fires and more particularly to a method of controlling toxic outgassing of certain burning or smouldering materials.

In recent years polymeric materials have been used more and more for structural components and for interior furnishings of buildings. Many of these materials contain halogen, cyanide, and/or other nitrogenous mixtures, which can react during combustion or pyrolysis to form toxic products such as hydrogen chloride (HCl) and hydrogen cyanide (HCN). Because of the danger to life and property, the response of these materials to fire needs to be readily controlled.

Experience has shown that one must be careful in interpreting the terminology used to describe varying degrees of fire resistance. Self-extinguishing materials burn as long as a source of external heat is present but are incapable of sustaining combustion after removal of the heat source. The fire characteristics of a self-extinguishing grade of polyurethane foam can be drastically changed by the processing it undergoes to produce a good microwave absorber. Treatment with fire retardants does not produce a nonflammable material; it only reduces flammability. A nonflammable material will not burn when exposed to a flame; however, foams that have been painted with a fire-retardant paint can lose their fire-retardant characteristics when the paint is destroyed, either mechanically or by fire.

The interior walls and ceiling of many modern anechoic chambers are covered with a nitrogen-containing polymer-polyurethane foam. To serve as a good microwave absorber, the foam is impregnated with a carbon and a latex binder to impart good electrical characteristics. The resulting material has low electrical resistance and is thus a good conductor. The foam is further treated with enough of a fire retardant, such as a chlorine-containing compound, to impart fire resistance with degrading electrical properties. When involved in fires, these treated foams may release toxic combustion products containing nitrogen and halogen, whose presence could significantly increase the toxicity of fire gases.

Further, it has been determined that these polymers release the irritant gas, hydrogen chloride (HCl). When air containing moderate concentrations of HCl gas is inhaled, the HCl is normally removed by the upper respiratory tract and does not penetrate into the lungs. However, it has been shown that the gas may be sorbed in hazardous quantities on airborne, fire-generated particles. If the particles are properly sized when inhaled, they carry the irritant gas past the defenses of the upper respiratory tract and deposit in the lungs. Desorbing from the particles, the gas then insults the delicate tissue of the lungs and causes pulmonary edema. This mechanism is believed to have caused deaths that occured 24 to 48 hours after exposure in certain fire situations.

Airborne soot and water particles are the suspected carriers of the irritant gas in fires. In burning experiments of polyvinyl chloride with polyethylene, soot particles have been shown to carry the irritant. When filtered from the fire gases, 2 percent by weight of the particles have been found to be loosely bound HCl. Electron micrographs show that the particles are sperically shaped with diameters of from 0.03 to 0.11 microns. According to theory, such particles cluster into assemblies that, for periods of 30 to 60 minutes, are of sizes that penetrate the respiratory defenses; 20 to 40 percent of the inhaled particles succeed.

Atmospheric analysis of different types of foams indicate that the combustion products contain toluene diisocyanate, HCN, HCl, $CO_2$ and CO. These gases will cause discomfort in a short period of time and even death after an hour in some cases. Experimental tests have been reported in an NRL Report 7793 entitled "Flammability and Toxic-Gas Production from Urethane Foams used in Anechoic Chambers", by Patricia A. Tatem and Frederick W. Williams, Naval Research Laboratory, Washington, D.C. 20375.

The almost opaque airborne soot compounds the fire fighter's problem. Visibility is so poor that personnel must be continually accounted for and the buddy system used.

The problem with burning foam is it will burn as long as heat is applied, even if it has a fire retardant in the foam. There is little firemen can do to control smouldering RF absorber material other than contain products of combustion and wait for smouldering to gradually stop. Normal use of water, foam, $CO_2$ and soda acid extinguishers do nothing to control outgassing. In most RF absorbers, even fire retardant polyurethane, smouldering continues unless the temperature is lowered because the material contains its own oxidizer and can burn slowly for hours. Therefore, some method must be used to extinguish the burning and smoulding foam materials while preventing toxic outgassing.

SUMMARY OF THE INVENTION

This invention provides a method by which burning or smouldering RF absorber materials may be controlled to avoid toxic outgassing.

BRIEF DESCRIPTION OF THE DRAWING

The drawing illustrates a fire extinguishing system.

DETAILED DESCRIPTION

In carrying out this invention, ammonia gas is mixed with water or steam and sprayed onto any smouldering material via the ventilation system via existing open head sprinkler plumbing, or by a special plumbing arrangement including a nozzle system connected with the ammonia-water apparatus. When sprayed onto the smouldering material the ammonia combines with HCN + HCl in the formula $2NH_3 + HCN + HCl \overset{cooled}{\rightleftharpoons} NH_4CN + NH_4Cl$. The process is reversible but yields relatively harmless precipitates when cooled by the water or steam. CO combines with $O_2$ to form $CO_2$; $6CO + 3O_2 \rightarrow 6CO_2$. Since $NH_3$ is much lighter than air; in a closed chamber or room, the $NH_3$ produced will rise to the top since it is about 60% the weight of air. The $NH_3$ excess can be removed by use of an exhaust fan.

FIG. 1 illustrates a suitable, simple device for mixing ammonia gas and water and for spraying the mixture into a chamber. The system includes a pressure tank 10 within which the $NH_3$ is stored and controlled by valve 11. An outlet line 12 connects at one end to the ammonia gas tank valve. The outlet line includes an automatic control valve 13 which may be made operational by heat from a flame or by hand. A pressure line 14 from a water tank 15 connects to the outlet line between the valve 13 and a venturi 16 near the end of the outlet line. A line 17 connects to the venturi of the outlet line and extends to near the bottom of the water tank so that water will be forced up and drawn up from the tank and mixed with the $NH_3$ at the venturi of the outlet line due to a Bernoulli pressure difference as well known in the spraying art. The low pressure outlet end 18 of the outlet line is directed into a room or other suitable dispensing system and the $NH_3 + H_2O$ mixture directed onto the surface of interest. The mixture may be directed into the ventilation system or a special plumbing arrangement from which the mixture may be sprayed onto any smouldering or burning RF absorbing materials. Any $NH_3$ gas accumulating in the upper area of the closed area should be exhausted by a fan.

The ammonia gas-water mixture system may be used with an anechoic chamber. In the event of a fire, the valve, which may be automatic, will be opened and the area must be evacuated of all personnel and the chamber doors closed because the burning of foam produces HCl and HCN which are very toxic. The $NH_3+H_2O$ cools the burning foam while reacting with HCl and HCN to produce $NH_4CN + NH_4Cl$ which will be precipitated harmlessly. With the forming of $NH_4Cl$ and $NH_4CN$ the smouldering or burning of fire protected foams will cease and the personnel may return upon removal of the gases within the chamber. As set forth before, a fan is used to remove any $NH_3$ in the upper area of the room. Thus, it is seen that the addition of a mixture of $NH_3$ and $H_2O$ will control of the burning or smouldering of RF absorber materials.

In cold weather instead of using water which may freeze in storage, steam may be used and mixed with the $NH_3$ prior to injection into the enclosed area. Expansion of the mixture in either case has an additional cooling effect. The strong odor of ammonia can serve as olfactory alarm that an automatic system has been set off and that personnel must evacuate the area. Prolonged containment of the products of sustained combustion may contribute to flash-over; therefore the exhaust fan is recommended for purging as well as for enabling fire fighters to reach the burning material.

Obviously many modifications and variations of the present invention are possible in light of the above teachings. It is therefore to be understood that within the scope of the appended claims the invention may be practiced otherwise than as specifically described.

WHAT IS CLAIMED AND DESIRED TO BE SECURED BY LETTERS PATENT OF THE UNITED STATES IS:

1. A method of controlling toxic outgassing from smouldering and burning materials which produces hydrogen cyanide and/or hydrogen chloride under such conditions which comprises:

mixing ammonia with steam; and spraying said ammonia-steam mixture on said materials to combine with gases produced by said materials.

2. A method as claimed in claim 1, wherein:

said ammonia-steam mixture combines with gases from said materials in the formula $$2NH_3 + HCN + HCl \rightleftharpoons NH_4CN + NH_4Cl.$$

* * * * *